US008251763B1

(12) United States Patent
Rositas

(10) Patent No.: US 8,251,763 B1
(45) Date of Patent: Aug. 28, 2012

(54) LIFE JACKET BEACON

(76) Inventor: Armando Rositas, Okemos, MI (US)

( * ) Notice: Subject to any disclaimer, the term of this patent is extended or adjusted under 35 U.S.C. 154(b) by 129 days.

(21) Appl. No.: 12/837,620

(22) Filed: Jul. 16, 2010

Related U.S. Application Data

(60) Provisional application No. 61/226,415, filed on Jul. 17, 2009.

(51) Int. Cl.
*B63B 22/00* (2006.01)

(52) U.S. Cl. ..... 441/11; 441/6

(58) Field of Classification Search ..... 441/6, 89, 441/11, 20, 23, 28; 405/185, 186, 187
See application file for complete search history.

(56) References Cited

U.S. PATENT DOCUMENTS

| | | | | |
|---|---|---|---|---|
| 3,212,113 | A | 10/1965 | Barrett | |
| 3,877,096 | A * | 4/1975 | Scesney | 441/6 |
| 4,598,661 | A | 7/1986 | Roe | |
| 4,752,264 | A | 6/1988 | Melendez et al. | |
| 4,919,452 | A | 4/1990 | Cimino | |
| 5,083,956 | A | 1/1992 | Chraghchian et al. | |
| 5,114,369 | A | 5/1992 | Coffey | |
| 5,411,424 | A * | 5/1995 | Hill | 441/6 |
| 5,423,282 | A | 6/1995 | Krull et al. | |
| 5,514,016 | A | 5/1996 | Larson | |
| 5,800,227 | A | 9/1998 | Brown, Jr. | |
| 5,893,786 | A | 4/1999 | Stevens | |
| 6,203,390 | B1 | 3/2001 | Elliott | |
| 6,220,910 | B1 | 4/2001 | Richey | |
| 7,812,732 | B1 | 10/2010 | Brouillard | |

OTHER PUBLICATIONS

Web page from www.aquaflare.com, "Easy Installation," Jun. 9, 2010.

* cited by examiner

*Primary Examiner* — Lars A Olson
(74) *Attorney, Agent, or Firm* — Mary M. Moyne; Fraser Trebilcock

(57) ABSTRACT

The beacon for increasing the visibility of a person floating in water. The beacon includes a flotation core constructed of a buoyant material, an outer cover and an attachment mechanism. The attachment mechanism allows the beacon to be attached to a user, user's clothing or life jacket worn by the user. The beacon floats in an essentially vertical position when the bottom end of the beacon is submerged in water.

1 Claim, 4 Drawing Sheets

LIFE JACKET BEACON

CROSS REFERENCES TO RELATED APPLICATIONS

This application claims the benefit of U.S. Provisional Application No. 61/226,415, filed Jul. 17, 2009, which is hereby incorporated herein by reference in its entirety, except that the present application supersedes any portion of the above referenced application which is inconsistent with the present application.

STATEMENT REGARDING FEDERALLY SPONSORED RESEARCH OR DEVELOPMENT

Not Applicable

BACKGROUND OF THE INVENTION

Field of the Invention

The present invention relates to a beacon which attaches to a user to indicate the location of a user when the user is in the water. In particular, the present invention relates to a beacon which is removably attached to a life jacket of a user and which floats in an essentially vertical orientation when the user is in the water so that the beacon increases the visibility of the user in the water.

BRIEF SUMMARY OF THE INVENTION

The beacon of the present invention is used to increase the visibility of a person floating in water. The beacon includes a flotation core. The flotation core is constructed of a buoyant material. In one (1) embodiment, the flotation core has a cylindrical shape with a center bore extending between the ends of the flotation core. In one (1) embodiment, the flotation core is covered by an outer cover. The beacon has an attachment mechanism located at the bottom end of the beacon. The attachment mechanism allows the beacon to be attached to a user, user's clothing or life jacket worn by the user. In one (1) embodiment, the attachment mechanism is a swivel clip which allows the beacon to rotate 360° at the attachment point. The attachment mechanism and outer cover are constructed of light weight materials that do not degrade in water or sunlight.

The beacon is clipped to a person who might end up in the water and may need rescuing or who may present an obstacle to boaters. Optimally, the person is wearing a life jacket and the beacon is attached to the life jacket. The bottom end of the beacon is attached to the person or life jacket at a location so that if that location is below the water, it is likely that the person is floating in water and requires extra visibility or possibility rescuing. When the bottom end of the beacon becomes submerged in water, the beacon floats in the essentially vertical position so that the top end of the beacon is visible above the water. In one (1) embodiment, the top end of the beacon extends above and is visible above the head of the user. The outer cover, or the flotation core if not covered by an outer cover, has a bright and highly visible color. In one (1) embodiment the beacon is provided with a reflective strip adjacent the top end of the beacon.

The flexibility, rotatability and movability of the attachment mechanism allow the beacon to be moved out of the way when the user is not in the water. The flexibility, rotatability and movability of the attachment mechanism allow the beacon to quickly move to the essentially vertical position when the bottom end of the beacon is submerged in water. In one (1) embodiment, the beacon is attached to a strap of the life jacket by a clip which can move along the strap. The added movability of the beacon on the strap of the life jacket assists in allowing the beacon to quickly move to a position where the beacon can float in the essentially vertical orientation. The use of a reusable and removable attachment mechanism enables the beacon to be removed from the life jacket of user when not in use and attached to another life jacket or user.

The present invention relates to a beacon for use in water which comprises a buoyant core having a first end and a second end with a longitudinal axis extending there between, and an attachment mechanism mounted adjacent the second end of the buoyant core.

Further, the present invention relates to a beacon for use in water, which comprises a flotation core constructed of a buoyant material, an outer cover completely surrounding the flotation core, and an attachment mechanism secured to the outer cover and adapted to removably connect the beacon to a person.

Still further, the present invention relates to a method for increasing visibility of a user in water which comprises the steps of providing a beacon having opposed top and bottom ends with a buoyant core having a first end adjacent a top end of the beacon and a second end adjacent a bottom end of the beacon, the first and second ends of the buoyant core forming a longitudinal axis of the buoyant core and the beacon, and having an attachment mechanism mounted adjacent the bottom end of the beacon, and attaching the beacon to the user using the attachment mechanism so that an attachment point of the beacon to the user is below a head of the user so that when the user is in the water and the second end of the buoyant core of the beacon is in the water, the beacon extends upward in a direction away from the water with the longitudinal axis of the beacon in an essentially vertical orientation so that the first end of the beacon extends above a head of the user.

Further still, the present invention relates to a method for increasing visibility of a user having a life jacket and floating in water, which comprises the steps of providing a beacon having opposed top and bottom ends and having a flotation core surrounded by an outer cover with an attachment mechanism flexibly connected to the bottom end of the beacon, and connecting the beacon to the life jacket adjacent a lower part of the life jacket so that when the life jacket is in the water and the attachment mechanism and bottom end of the beacon are submerged in the water, the beacon floats adjacent the life jacket in an essentially vertical orientation with the top end of the beacon extending out of the water.

The substance and advantages of the present invention will become increasingly apparent by reference to the following drawings and the description.

DETAILED DESCRIPTION OF THE INVENTION

Figure 4:
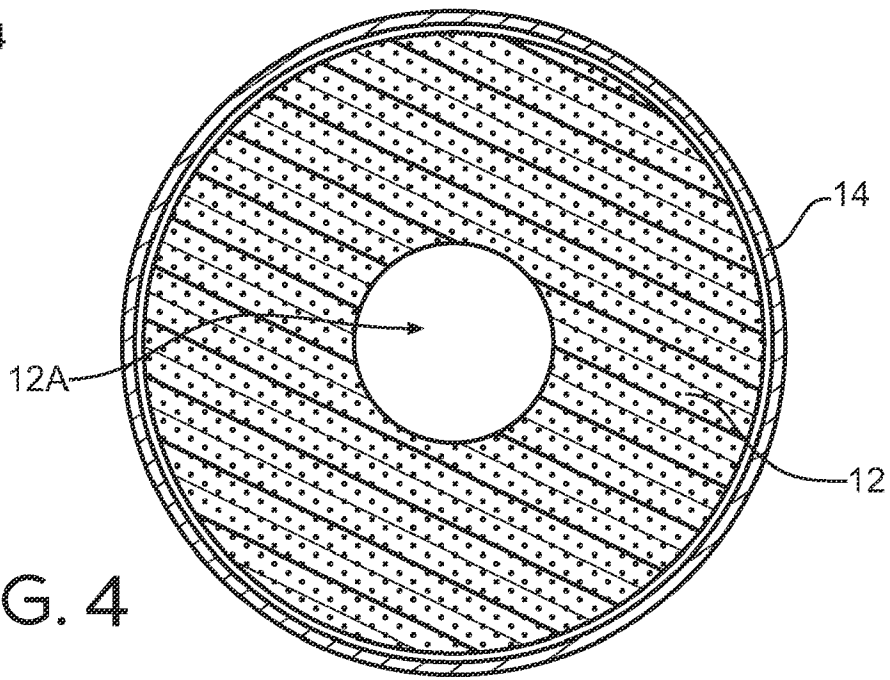
FIG. 4 is a cross section view along the line 4-4 of FIG. 3 showing the flotation core 12 and the center bore 12A.
Figure 5:
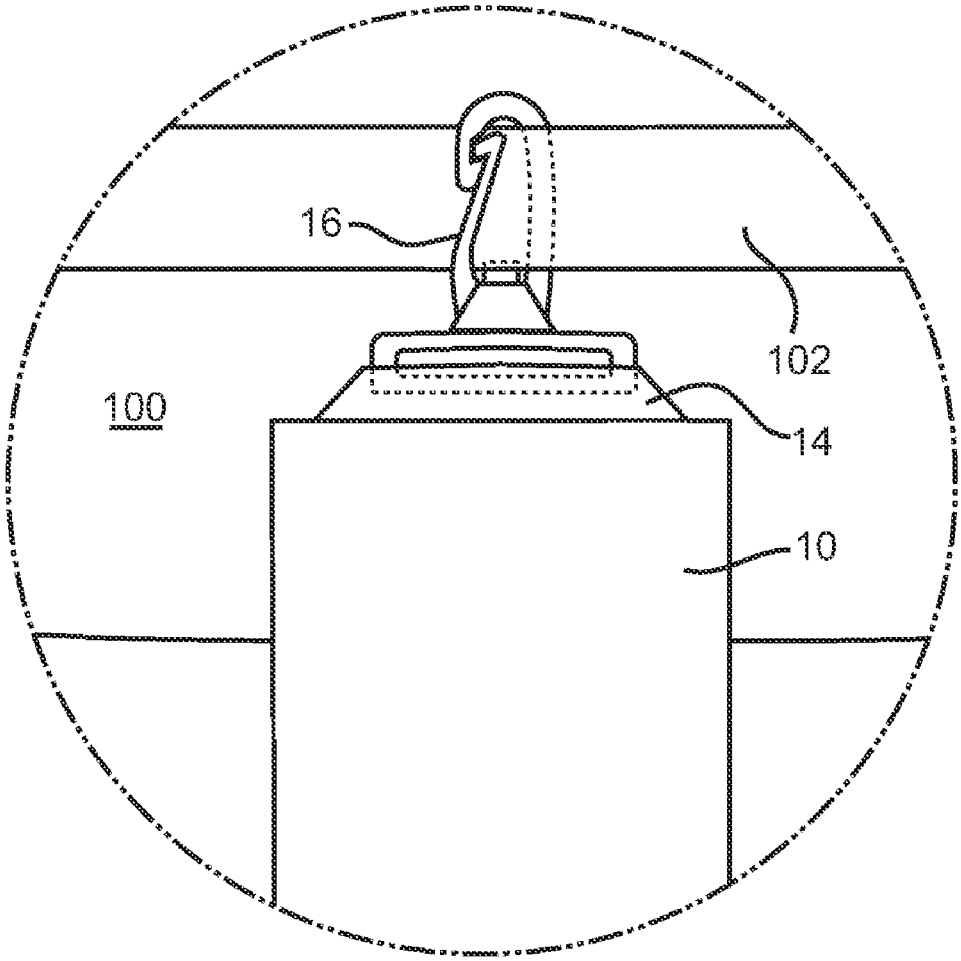
FIG. 5 is an enlarged view of FIG. 1 showing the attachment mechanism 16 of the beacon 10 attached to a strap 102 of the life jacket 100.

FIGS. 1 to 5 show the beacon 10 of the present invention. The beacon 10 includes a flotation core 12, an outer cover 14 and an attachment mechanism 16. The beacon 10 has a top end 10A and a bottom end 10B. In one (1) embodiment, the beacon 10 has an essentially cylindrical shape. However, it is understood that the beacon 10 can have a variety of shapes. The flotation core 12 has a shape similar to the overall shape of the beacon 10. However, the flotation core 12 can have a variety of shapes. In one (1) embodiment, the flotation core 12 has a cylindrical shape. In one (1) embodiment, the flotation core 12 has opposed first and second ends with a center bore 12A extending therebetween along a longitudinal axis A-A of the flotation core 12 (FIG. 4). The center bore 12A increases the buoyancy of the flotation core 12 and allows the flotation core 12 to move to the essentially vertical orientation faster when submerged or partially submerged in water. In one (1) embodiment, the flotation core 12 has a length of approximately 15 inches (381 mm). In one (1) embodiment, the flotation core 12 has an outer diameter of approximately 2.5 inches (63.5 mm) and the center bore 12A has a diameter of approximately 0.5 inches (12.7 mm). In one (1) embodiment, the flotation core 12 is constructed of Styrofoam®. In one (1) embodiment, the flotation core 12 is constructed of polyethylene. However, it is understood that the flotation core 12 can be constructed of any buoyant material.

The outer cover 14 completely surrounds and covers the flotation core 12 and protects the flotation core 12 from damage. In an alternate embodiment, the beacon 10 does not have an outer cover 14. In one (1) embodiment, the outer cover 14 is constructed of a lightweight, durable and pliant material. In one (1) embodiment, the outer cover 14 is bendable, pliable and flexible. The outer cover 14 is constructed of a water resistant material which will not absorb water when the beacon 10 is in the water 106. In one (1) embodiment, the outer cover 14 is constructed of nylon. In one (1) embodiment, the outer cover 14 has a fluorescent color or a bright color which is highly visible in the water 106. A reflective stripe 18 is optionally provided around an outside of the outer cover 14 adjacent a top end 10A of the beacon 10. In the alternate embodiment where the beacon 10 does not have an outer cover, the flotation core 12 is a fluorescent color or a bright color or is coated with a material which is highly visible in the water 106. Optionally, a reflective stripe 18 is provided around the flotation core 12 adjacent the first end of the flotation core 12.

The attachment mechanism 16 is mounted on the bottom end 10B of the beacon 10. In one (1) embodiment, the attachment mechanism 16 is secured to the outer cover 14 adjacent the second end of the flotation core 12. In one (1) embodiment, the outer cover 14 extends beyond the second end of the flotation core 12 and the attachment mechanism 16 is secured to the outer cover 14 at a point spaced apart from the second end of the flotation core 12. In one (1) embodiment, the attachment mechanism 16 is attached to the flotation core 12 or outer cover 14 by a flexible strap (not shown). The flexible strap allows for additional movement of the beacon 10 when connected to the life jacket 100. The flexibility or movability of the outer cover 14 or of the flexible strap enables the beacon 10 to swing and drop down when the user 104 is not in the water 106 and to float upward when the user 104 is in the water 106 and the bottom end 10B of the beacon 10 is submerged in water. In the alternate embodiment where the beacon 10 does not have an outer cover, the attachment mechanism 16 can be secured directly to the second end of the flotation core 12. In one (1) embodiment, the attachment mechanism 16 is constructed of a light weight and durable material which does not degrade in water. In one (1) embodiment, the attachment mechanism 16 is constructed of plastic. In one (1) embodiment, the attachment mechanism 16 is a snap swivel hook or clip which allows the beacon 10 to rotate 360° at the attachment point. However, it is understood that any type of attachment mechanism 16 which allows for repeated removal and fastening of the beacon 10 can be used. In one (1) embodiment, the flotation core 12 has a length of approximately 15 inches (381 mm), the outer cover 14 extends beyond the second end of the flotation core 12 approximately 1.5 inches (38.1 mm) and the attachment mechanism 16 has a length of approximately 2.5 inches (63.5 mm). In one (1) embodiment, the beacon 10 has a length between the ends 10A and 10B of approximately 19 inches (483 mm).

Figure 2:
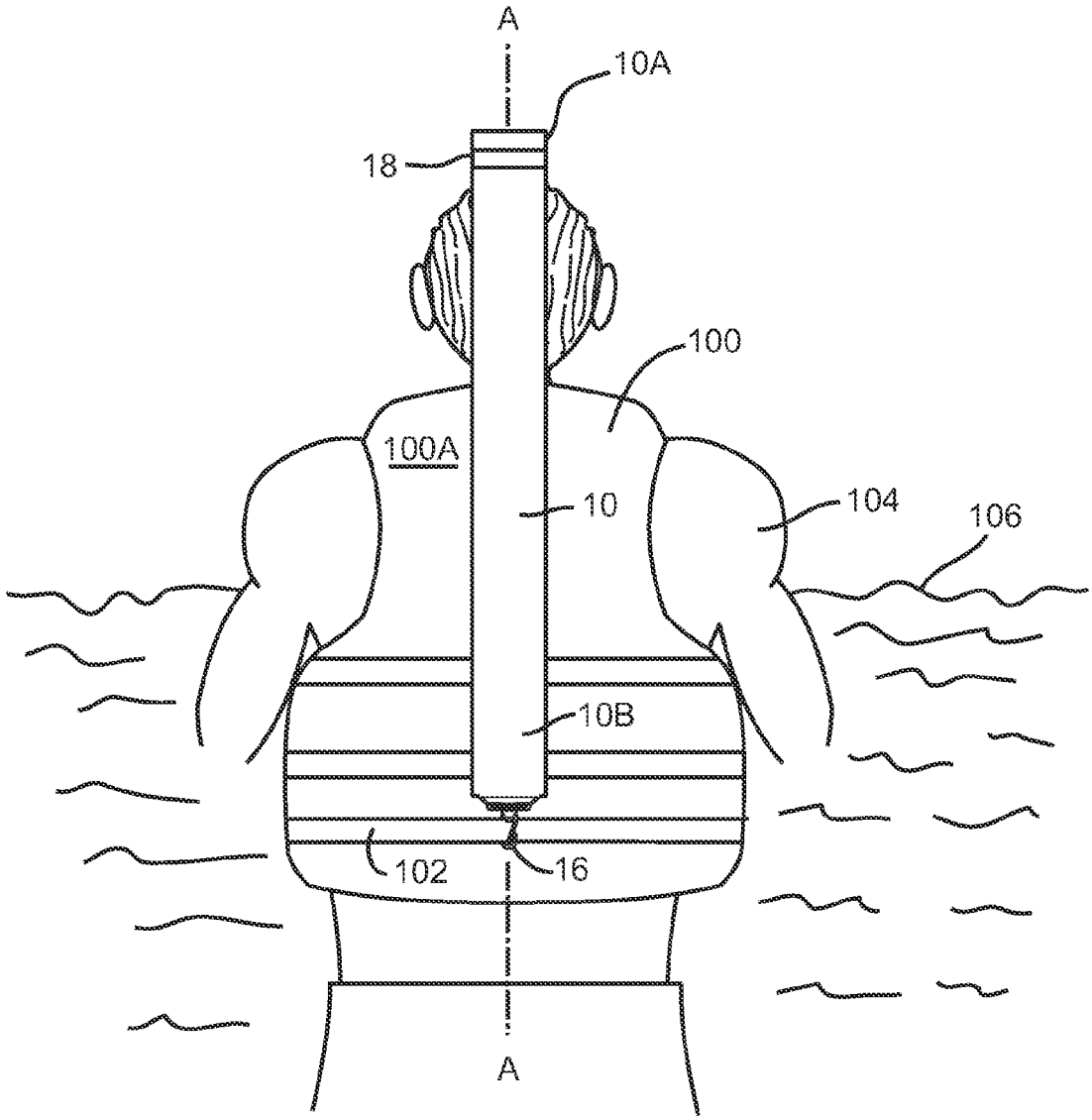
FIG. 2 is a back view of a life jacket 100 showing the beacon 10 in the floating position, when the user 104 is in the water 106.
Figure 3:
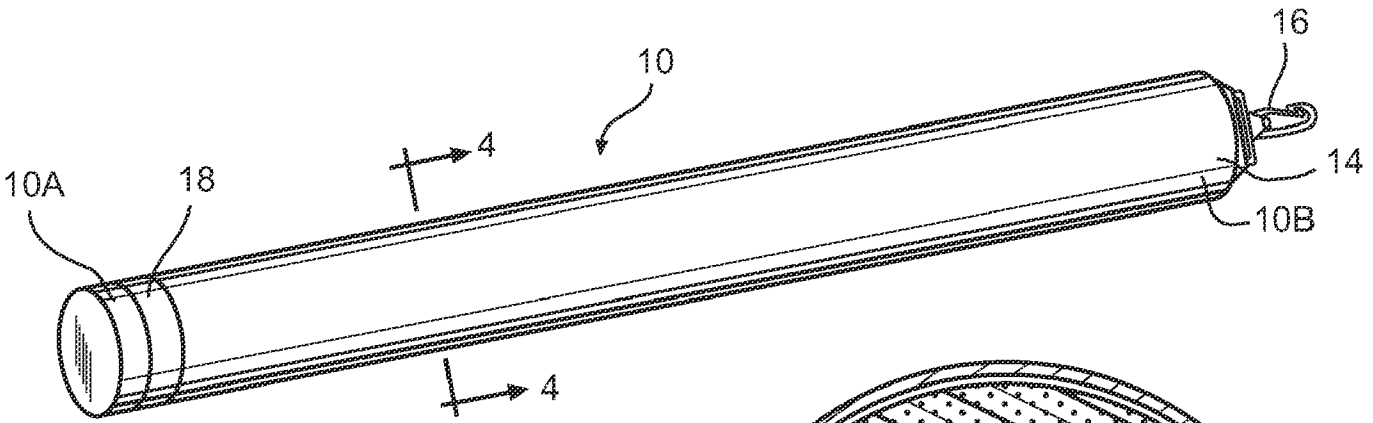
FIG. 3 is perspective view of the beacon 10.

The beacon 10 is intended to be connected to a back 100A of a life jacket 100 or life vest. However, it is understood that the beacon 10 can be attached to a front or side of the life jacket 100. In one (1) embodiment, the beacon 10 is attached directly to a user 104. In one (1) embodiment, the beacon 10 is attached to the clothing of the user 104. In one (1) embodiment, the beacon 10 is attached to a tightening strap 102 of the life jacket 100. However, it is understood that the beacon 10 could be attached to the life jacket 100 at any convenient location which enables the beacon 10 to float in an essentially vertical orientation when the user 104 is in the water 106 such as when the life jacket 100 is keeping the user 104 afloat in the water 106 (FIG. 2). In the embodiment where the beacon 10 is attached to a tightening strap 102 of the life jacket 100, the attachment mechanism 16 is selected so that the attachment mechanism 16 can move along the tightening strap 102 on the life jacket 100. In the one (1) embodiment where the attachment mechanism 16 is a swivel clip, the opening of the clip has a size greater than the width and thickness of the tightening strap 102 so that the clip can easily move along a length of the tightening strap 102. The movability of the beacon 10 on the tightening strap 102 enables the location of the beacon 10 to be adjusted to a more comfortable position when the user 104 is not in the water 106. The movability of the attachment mechanism 16 on the tightening strap 102 allows the beacon 10 to move into a correct floatation position when the user 104 is in the water 106. In one (1) embodiment, the beacon 10 moves automatically on the strap 102 due to the movement of the water 106 and the movement of the user 104. The beacon 10 may be moved by the user 104 to a position along the tightening strap 102 which maximizes the visibility of the beacon 10 when the user 104 is in the water 106. In one (1) embodiment, the life jacket 100 has multiple tightening straps 102 spaced vertically along the back 100A of the life jacket 100. In this embodiment, the beacon 10 can be connected to any of the tightening straps 102. The beacon 10 is attached adjacent a lower part or bottom portion of the life jacket 100 so that the bottom end 10B of the beacon 10 is submerged while the user's head remains above the water 106. When the bottom end 10B of the beacon 10 is below the surface of the water 106, the beacon 10 floats in an essentially vertical orientation. In one (1) embodiment, when the beacon 10 is partially submerged in water, the flotation core 12 is in the essentially vertical position with the longitudinal axis A-A of the flotation core 12 in an essentially vertical orientation. In one (1) embodiment where the beacon 10 has a length of approximately 19 inches (483 mm) including the attachment mechanism 16 and the outer cover 14, the beacon 10 will move to the essentially vertical position when approximately 6 inches (152 mm) of the beacon 10 is submerged. When the beacon 10 initially moves to the essentially vertical position, approximately 13 inches (330 mm) of the beacon 10 extends above the surface of the water. The length of the flotation core 12 is chosen so that when a user 104 is in the water 106 and the bottom portion of the back 100A of the life jacket 100 is essentially completely in the water 106 so that the attachment point of the beacon 10 to the life jacket 100 is below the surface of the water 106, the top end 10A of the beacon 10 and the flotation core 12 are above the surface of the water 106 and extend beyond a top of the head of the user 104 (FIG. 2). In the embodiment where a reflective stripe 18 is provided on the top end 10A of the beacon 10, the reflective stripe 18 is also above the head of the user 104. The reflective stripe 18 allows for easier locating of the beacon 10 and user 104 at night when a light strikes the beacon 10. The reflective stripe 18 may also reflect sunlight and allow for easier spotting of the user 104 in the water 106 during the day.

The location of the attachment point of the beacon 10 may depend on the height of the user 104. In one (1) embodiment, where the user 104 is tall or taller than average, the beacon 10 can be connected to an upper strap of the life jacket 100 located near the shoulders of the user 104. The attachment of the beacon 10 at a high point on the life jacket 100 enables the beacon 10 to float above the user's head when the user 104 is in the water 106. In another embodiment, where the user 104 is short or shorter than average, the beacon 10 can be connected to a lower strap of the life jacket 100 located near a waist of the user 104. The lower point of connection of the beacon 10 allows for the beacon 10 to become submerged more quickly and to float sooner when the user 104 is in the water thus providing added visibility sooner. Optimally, the bottom end 10B of the beacon 10 is attached to the user 104 at a point below the neck of the user 104.

In the embodiment where the attachment mechanism 16 is a snap swivel hook or clip, the snap swivel clip allows the beacon 10 to rotate 360° about the attachment point to the life jacket 100. The ability of the beacon 10 to swivel at the attachment point as well as the ability of the beacon 10 to move along the tightening strap 102 to adjust the connection point enables the beacon 10 to be positioned by the user 104 in the optimal location for the highest visibility. The movability and adjustability of the beacon 10 also allows the beacon 10 to be moved out of the way when not in use and to automatically move to a floatation location when the beacon 10 is in the water 106. The moveable and pliable attachment of the beacon 10 to the life jacket 100 allows the beacon 10 to float in the water 106 in an essentially vertical orientation independent of the position of the user 104 as long as the beacon 10 is in the water 106. In addition, in the embodiment where the attachment mechanism 16 is connected by a flexible strap, a length of the strap is such that when not in use, the beacon 10 does not interfere with the user 104 and when the user 104 is in the water 106, the beacon 10 is able to float adjacent the user 104 even if the user 104 is floating on his back and the beacon 10 is connected to the back 100A of the life jacket 100.

Figure 1:
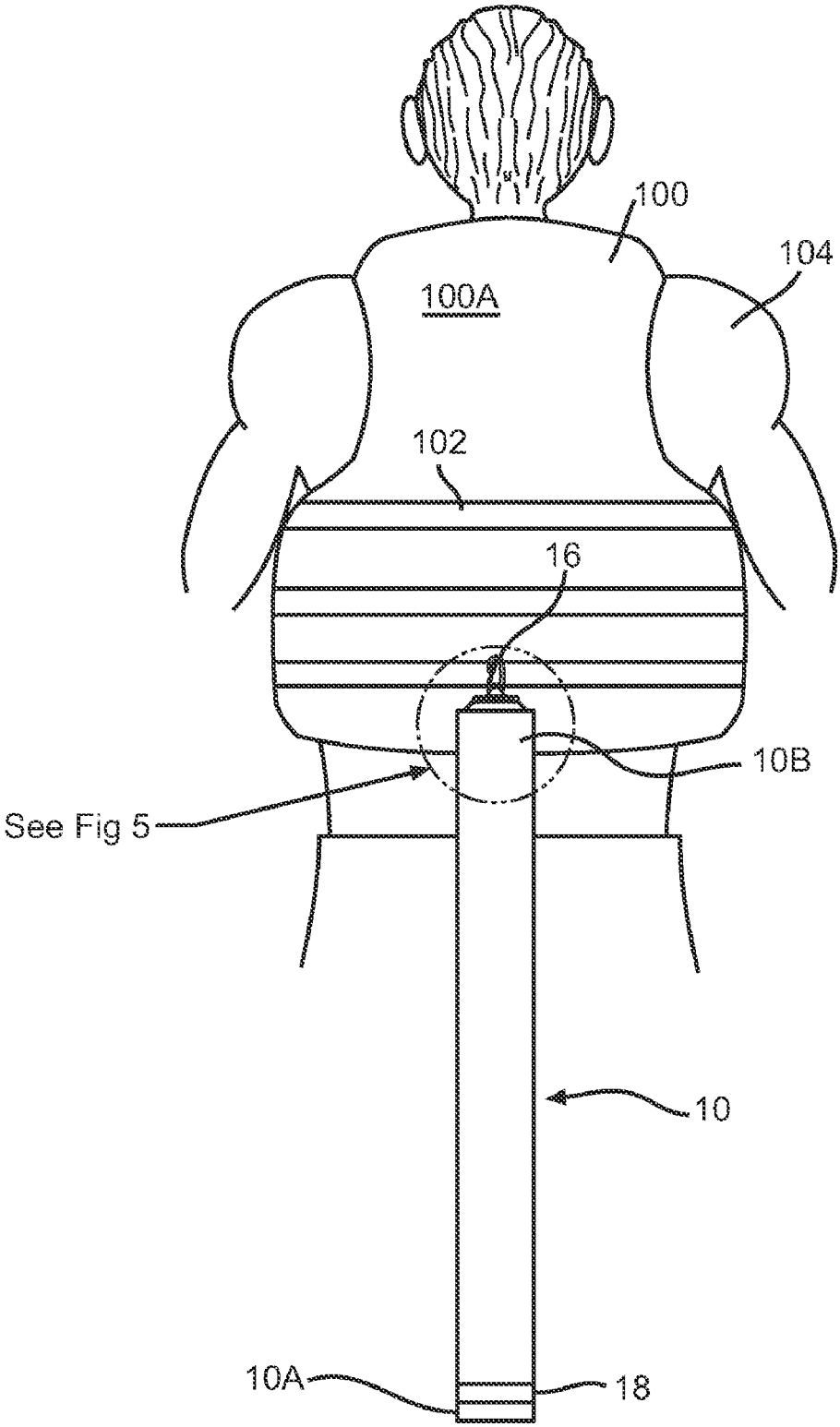
FIG. 1 is a back view of a life jacket 100 showing the beacon 10 in the at rest position.

The beacon 10 is removably attached to a life jacket 100 or clothing of the user or directly to a user. The use of the attachment mechanism 16, for example the clip, allows the beacon 10 to be removed when a user 104 is not in the water 106. Thus, the beacon 10 can be positioned on the back 100A of the life jacket 100 and can be removed so that the beacon 10 does not create discomfort to the user 104 when the user 104 is not in the water 106. The removability of the beacon 10 allows the beacon 10 to be removed from a life jacket 100 which is not in use and to be quickly and easily transferred to a life jacket 100 which is in use. However, when the user 104 is not in the water 106 and the beacon 10 remains attached to the life jacket 100, the beacon 10 hangs down out of the way of the user 104 (FIG. 1). When the beacon 10 is not in the water and is located above the ground surface, the beacon 10 moves to an at rest position with the bottom end 10B above the top end 10A and the top end 10A pointed in a downward direction toward the ground surface (FIG. 1). When a user 104 is in the water 106 so that the beacon 10 is in the water 106 but the bottom end 10B of the beacon is not submerged so that the beacon floats in the essentially vertical position, the beacon 10 floats on the water 106 in an essentially horizontal position.

In the foregoing description, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are here by incorporated by reference herein in their entirety, with each claim standing on its own as a separate embodiment of the present invention.

It is intended that the foregoing description be only illustrative of the present invention and that the present invention be limited only by the hereinafter appended claims.

I claim:

1. A beacon for use in water, which comprises:

a) a flotation core constructed of a buoyant material having opposed first and second ends;

b) an outer cover completely surrounding and extending beyond the second end of the flotation core; and c) a snap swivel clip which rotates 360° mounted on the outer cover spaced apart from second end of the flotation core and adapted to removably connect the beacon to a person.

* * * * *